US009841035B2

(12) United States Patent
Wu et al.

(10) Patent No.: US 9,841,035 B2
(45) Date of Patent: Dec. 12, 2017

(54) HEAT DISSIPATION FAN

(71) Applicants: CHAMP TECH OPTICAL (FOSHAN) CORPORATION, Foshan (CN); Foxconn Technology Co., Ltd., New Taipei (TW)

(72) Inventors: Hong-Tao Wu, Foshan (CN); Chih-Feng Hu, New Taipei (TW)

(73) Assignee: CHAMP TECH OPTICAL (FOSHAN) CORPORATION, Foshan (CN)

( * ) Notice: Subject to any disclaimer, the term of this patent is extended or adjusted under 35 U.S.C. 154(b) by 225 days.

(21) Appl. No.: 14/738,051

(22) Filed: Jun. 12, 2015

(65) Prior Publication Data

US 2016/0327057 A1 Nov. 10, 2016

(30) Foreign Application Priority Data

May 4, 2015 (CN) ..... 2015 1 0219977

(51) Int. Cl.

| | |
|---|---|
| ***F04D 29/52*** | (2006.01) |
| ***F04D 19/00*** | (2006.01) |
| ***F04D 17/02*** | (2006.01) |
| ***F04D 25/06*** | (2006.01) |
| ***F04D 29/42*** | (2006.01) |

(52) U.S. Cl.

CPC ..... *F04D 29/522* (2013.01); *F04D 17/025* (2013.01); *F04D 19/002* (2013.01); *F04D 25/0613* (2013.01); *F04D 29/4226* (2013.01)

(58) Field of Classification Search

CPC .... F04D 29/522; F04D 17/025; F04D 19/002; F04D 25/0613; F04D 29/4226; F04D 25/08; F04D 29/325; F04D 29/541

See application file for complete search history.

(56) References Cited

U.S. PATENT DOCUMENTS

| | | | | |
|---|---|---|---|---|
| 2004/0012923 | A1 | 1/2004 | Chen | |
| 2005/0115403 | A1 | 6/2005 | Lyu | |
| 2006/0292010 | A1* | 12/2006 | Holston | F04D 29/601 416/244 R |
| 2012/0313475 | A1* | 12/2012 | Wu | F04D 29/329 310/156.38 |
| 2014/0010681 | A1 | 1/2014 | Wang | |
| 2015/0337860 | A1* | 11/2015 | Ho | F04D 29/646 416/90 R |

FOREIGN PATENT DOCUMENTS

| | | |
|---|---|---|
| KR | 20030085737 A | 6/2005 |
| TW | 399683 | 7/2000 |
| TW | M240604 | 8/2004 |

* cited by examiner

*Primary Examiner* — Dwayne J White
*Assistant Examiner* — Justin A Pruitt
(74) *Attorney, Agent, or Firm* — ScienBiziP, P.C.

(57) ABSTRACT

A heat dissipation fan includes a base plate, a frame formed on a side of the base plate, a stator received sin the frame, and a rotor below the stator and connected with the stator. The heat dissipation fan also has an air inlet, a first air outlet and a second air outlet. The air inlet is communicated with the first air outlet and the second air outlet. An angle is defined between each of the first air outlet and the second air outlet.

1 Claim, 5 Drawing Sheets

HEAT DISSIPATION FAN

CROSS-REFERENCE TO RELATED APPLICATIONS

This application claims priority to Chinese Patent Application No. 201510219977.7 filed on May 4, 2015, the contents of which are incorporated by reference herein.

FIELD

The subject matter herein generally relates to a heat dissipating device, especially, relates to a heat dissipation fan.

BACKGROUND

A fan is used to cool electrical components of electrical devices. The fan may be an axial fan or centrifugal fan. However, each the axial fan or the centrifugal fan has an outlet oriented towards a desired direction. When the outlet is covered, the electrical device may overheat.

BRIEF DESCRIPTION OF THE DRAWINGS

Implementations of the present technology will now be described, by way of example only, with reference to the attached figures.

DETAILED DESCRIPTION OF EMBODIMENTS

It will be appreciated that for simplicity and clarity of illustration, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure. The description is not to be considered as limiting the scope of the embodiments described herein.

A definition that applies throughout this disclosure will now be presented. The term "comprising" means "including, but not necessarily limited to"; it specifically indicates open-ended inclusion or membership in a so-described combination, group, series and the like.

Figure 1:
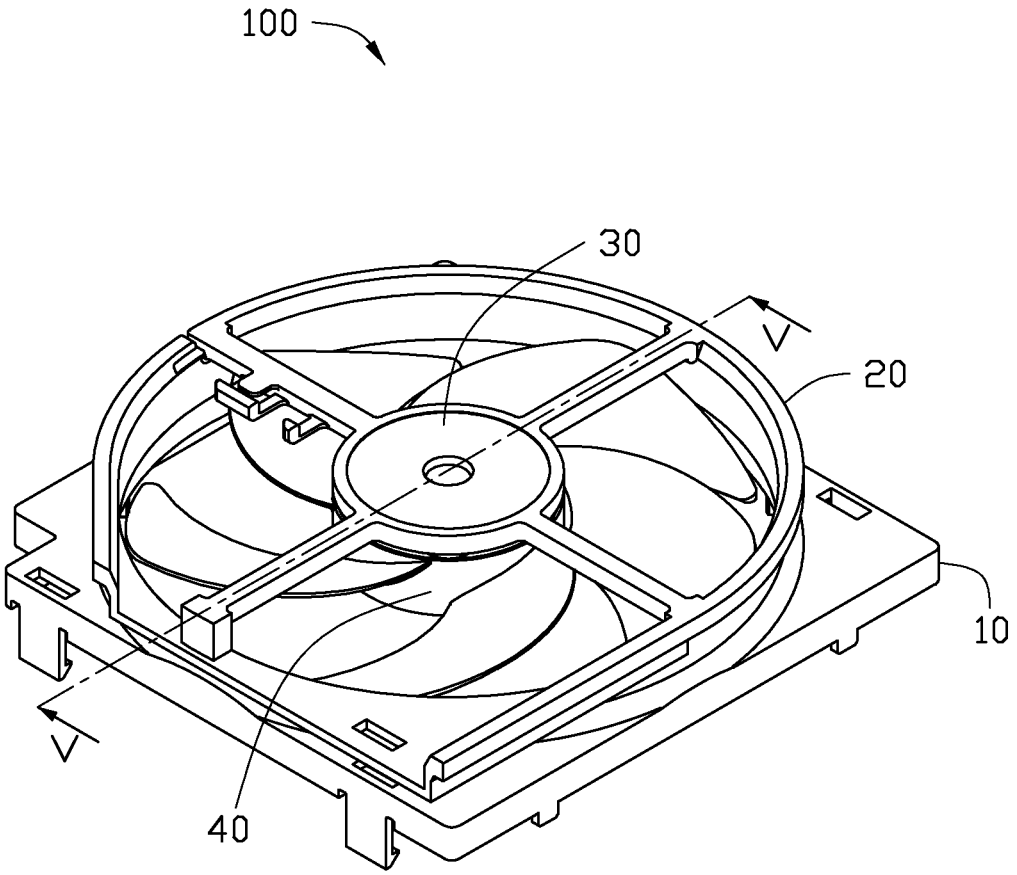
FIG. 1 is an assembled view of a heat dissipation fan of the present disclosure.
Figure 2:
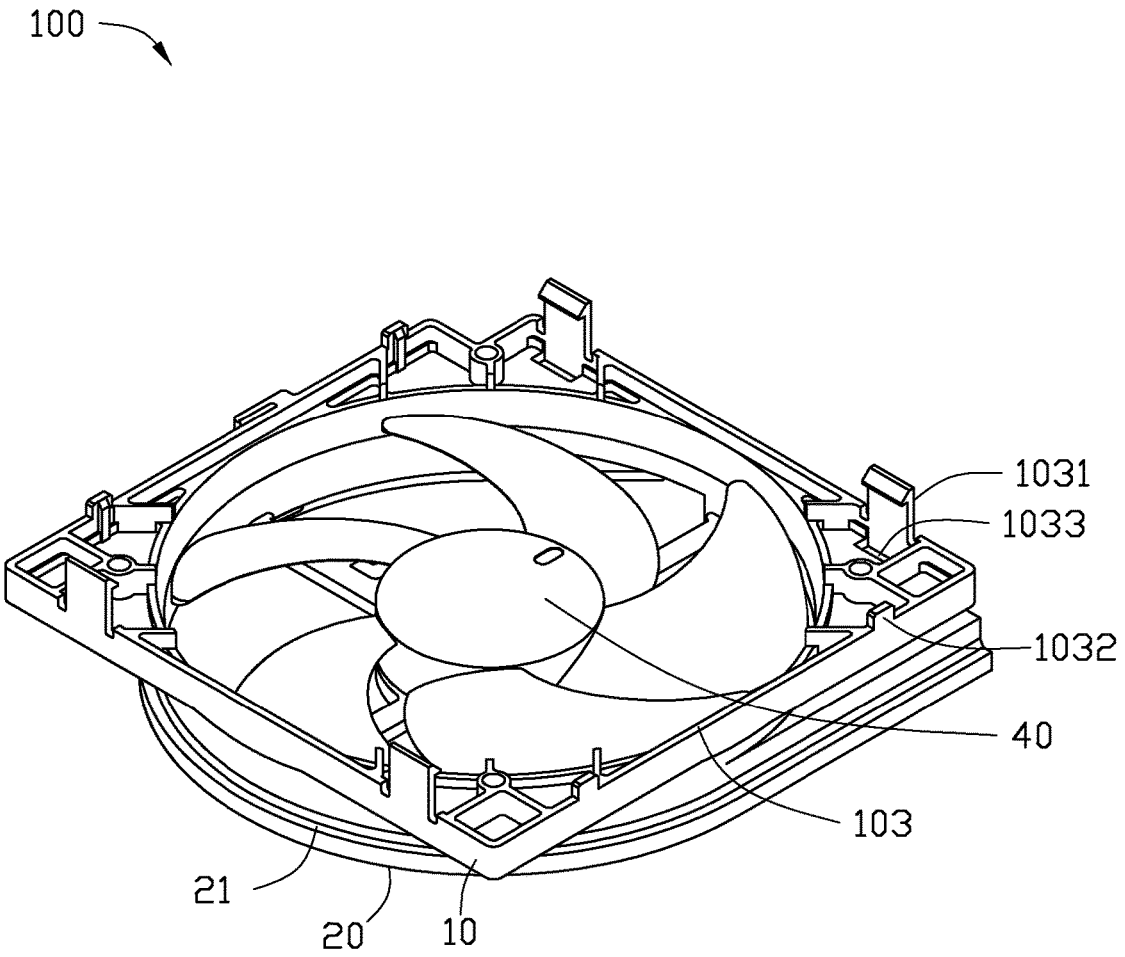
FIG. 2 is an assembled view similar to the heat dissipation fan of FIG. 1 but show from another angle.

Referring to FIGS. 1-2, a heat dissipation fan 100 of the present disclosure includes a base plate 10, a frame 20 formed on a top side of the base plate 10, a stator 30 received in the frame 20, and a rotor 40 below the stator 30 and connected with the stator 30.

Figure 3:
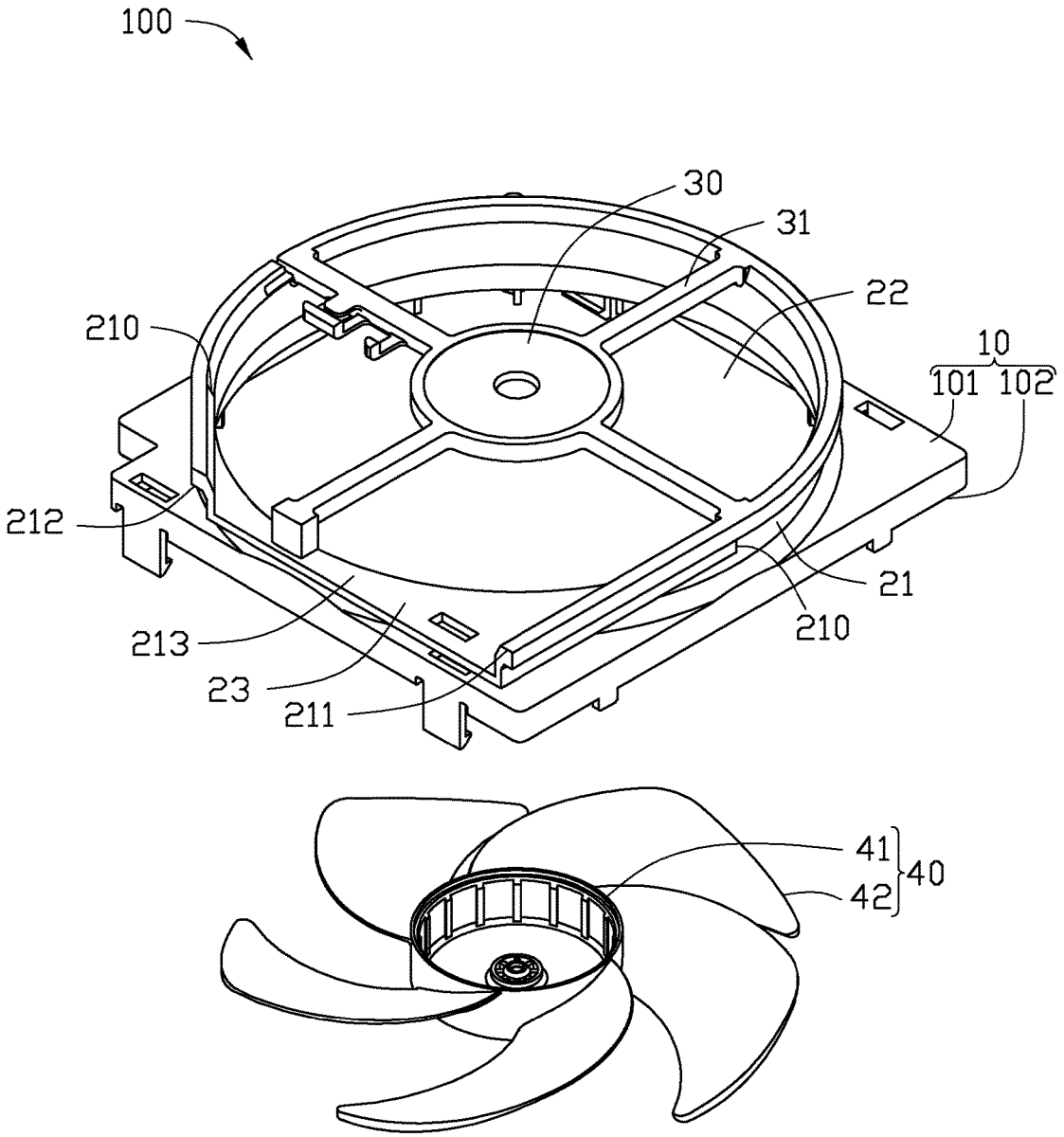
FIG. 3 is an exploded view of the heat dissipation fan of FIG. 1.
Figure 4:
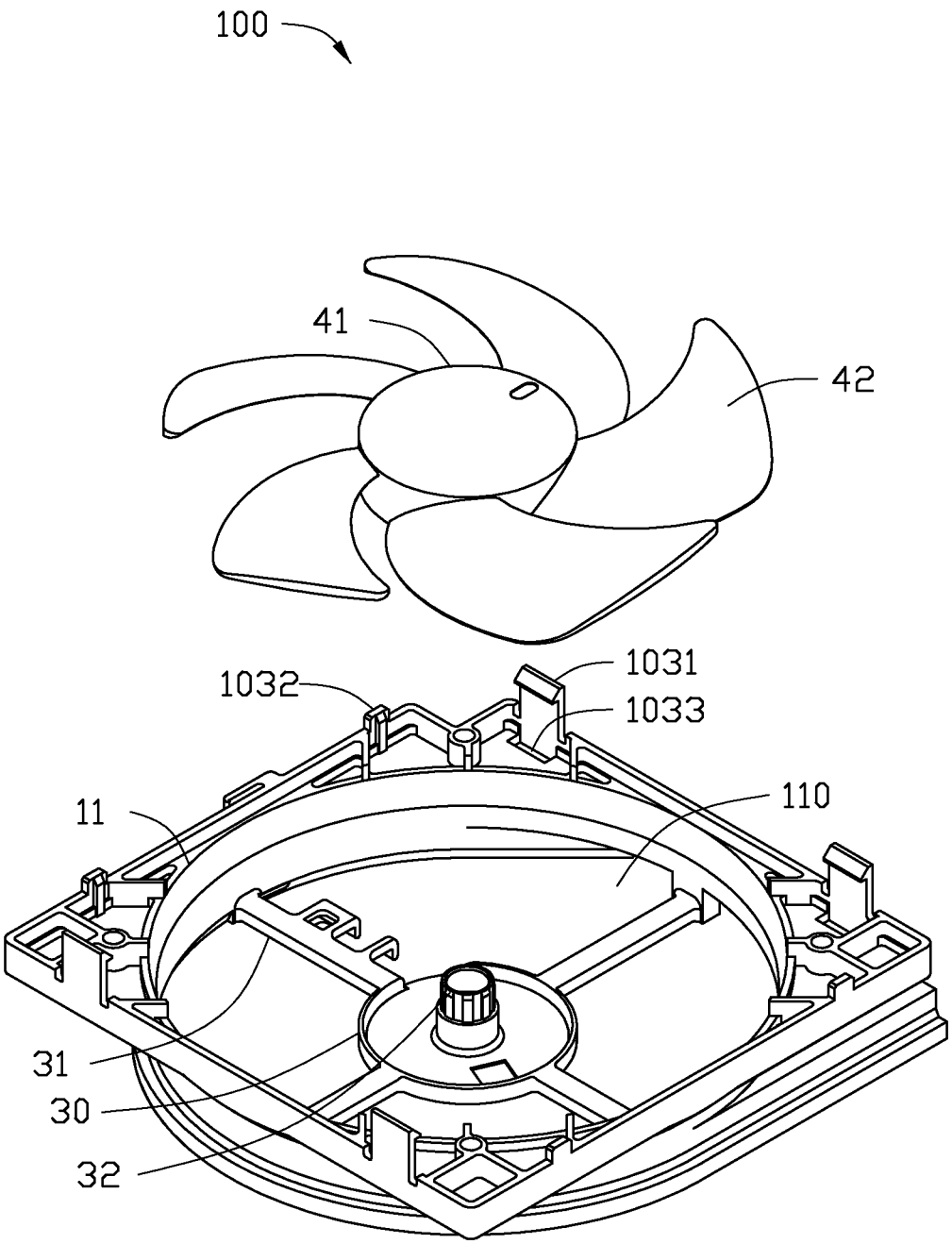
FIG. 4 is an exploded view of the heat dissipation fan of FIG. 2.

Referring also to FIGS. 3-4, the base plate 10 is a rectangular plate. The base plate 10 has a first side 101 and a second side 102 located opposite to the first side 101. A side wall 103 protrudes vertically downward from a periphery of the second side 102. The side wall 103 includes a first fixing portion 1031 and a second fixing portion 1032 to fix the heat dissipation fan to electrical device. The first fixing portion 1031 and the second portion 1032 protrude towards an extending direction of the side wall 103. In at least one embodiment, the number of the first fixing portion 1031 is four, the first fixing portions 1031 are respectively located at edges of two ends of the side wall 103; the number of the second fixing portion 1032 is four, the second fixing portions 1032 are respectively located at edges of the other side wall 103. A height of the first fixing portion 1031 is more than that of the second fixing portion 1032. An inner side of each first fixing portion 1031 has a through hole 1033.

The base plate 10 has a circular hole 11 defined in a central portion thereof. The circular hole 11 extends through the first side 101 and the second side 102. An end of the circular hole 11 towards the second side 102 is an air inlet 110.

The frame 20 is protruded upward and vertically from edges of the circular hole on the first side 101. The frame 20 includes a main portion 21. The main portion 21 defines a first air outlet 22 configured on a top end of the main portion 21, relatively to the air inlet 110, and a second outlet 23. An extending direction of the second air outlet 23 is angled with that of the first air outlet 22. Preferable, the extending direction of the first air outlet 22 and that of the second outlet are perpendicular.

The main portion 21 is arc-shaped and defines a cutout 210 on a side thereof. A first extending portion 211, a second extending portion 212 and a connecting plate 213 are extended outward along edges of the cutout 210 of the main portion 21. Specifically, the first extending portion 211 and the second extending portion 212 are face to each other and extend from opposite edges of the cutout 210. The first extending portion 211 and the second extending portion 212 are tangent with an outer periphery of the main portion 21. The connecting plate 213 extends from a bottom edges of the cutout 210 to connect bottom ends of the first extending portion 211 and the second extending portion 212. The first extending portion 211, the second extending portion 212, and the connecting plate 213 are cooperatively to define the second air outlet 23. An extending direction of the second air outlet 23 is vertical with an extending direction of the first air outlet 22.

The stator 30 is circular-shaped. A rotating shaft 32 is formed downward from an central portion of the stator 30 to drive the rotor 40. The stator 30 is connected with the frame 20 by a plurality of connecting arms 31. In at least this embodiment, the number of the connecting arms is four, and between each connecting arm is angled at 90 degree.

The rotor 40 is cylindrical, and received in the frame 20 to connect with the stator 30 by a rotating shaft 32. The rotor 40 includes a wheel hub 41 and multiple blades 42 extended outward and radially from peripheries of the wheel hub 41.

Figure 5:
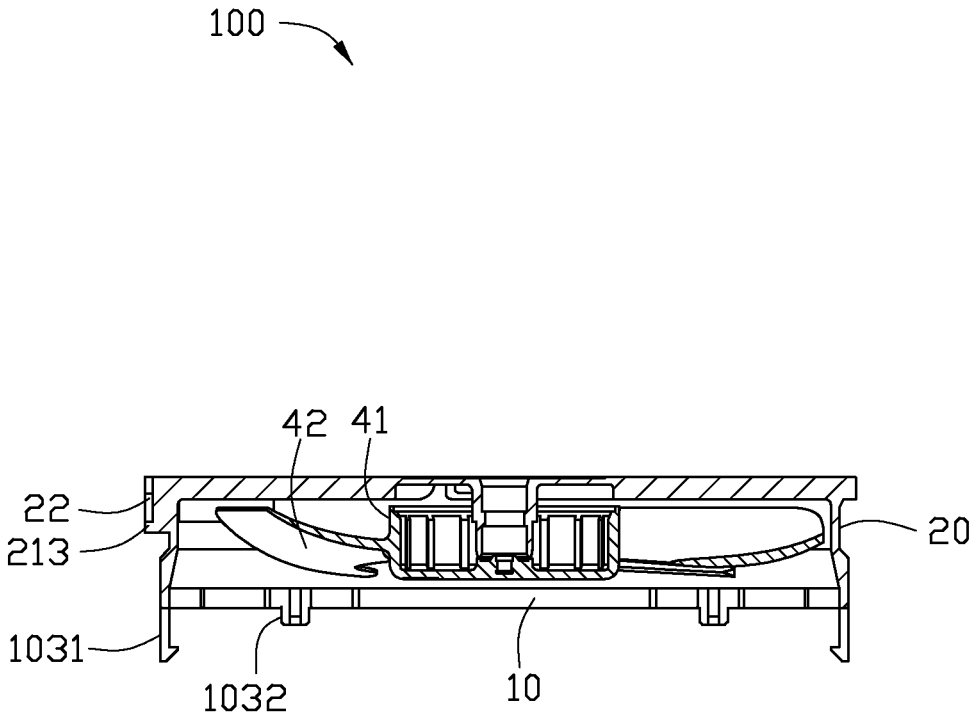
FIG. 5 is a cross sectional view of the heat dissipation fan of the present disclosure, taken along V-V line of FIG. 1.

Referring to FIG. 5, when the heat dissipation fan 100 is assembled, the rotor 40 connects with the stator 30 by the rotating shaft 32, and is received in the frame 20, an outer top end of the blades 42 is beyond of a top surface of the connecting plate 213. The airflow enters from the air inlet 110 and discharges from either of the first air outlet 22 and the second air outlet 23.

In this disclosure, both the first air outlet 22 and the second air outlet 23 discharge the airflow, so the heat dissipation fan 100 has a high cooling efficiency. While the first air outlet 22 or the second air outlet 23 is blocked, the heat dissipation fan 100 can discharge the airflow through the second air outlet 23 or the first air outlet 22. It can be understood that, the heat dissipation fan 100 of the present disclosure can configured multiple air outlets to avoid being blocking. An angle is defined between each of the first air outlets and multiple air outlets.

It is to be further understood that even though numerous characteristics and advantages have been set forth in the foregoing description of embodiments, together with details of the structures and functions of the embodiments, the disclosure is illustrative only; and that changes may be made in the details, including in matters of shape, size, and arrangement of parts within the principles of the disclosure to the full extent indicated by the broad general meaning of the terms in which the appended claims are expressed.

The embodiments shown and described above are only examples. Many details are often found in the art such as the other features of a heat dissipation fan. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A heat dissipation fan comprising:

a base plate having a top side, a first side and a second side, the second side located opposite to the first side;

a frame formed on the top side of the base plate;

a stator received in the frame; and a rotor below the stator and connected with the stator;

wherein the heat dissipation fan has an air inlet, a first air outlet and a second air outlet, the air inlet is communicated with the first air outlet and the second air outlet, an angle is defined between the first air outlet and the second air outlet, the frame includes a main portion, the main portion is arc-shaped and has a cutout on a side thereof, a first extending portion, a second extending portion and a connecting plate are extended outward along edges of the cutout of the main portion, the first extending portion and the second extending portion are tangent to the arcuate periphery of the main portion, the base plate has a circular hole defined in a central portion thereof, the frame is protruded upward and vertically from edges of the circular hole.

* * * * *